US008684231B2

(12) United States Patent
Lane et al.

(10) Patent No.: US 8,684,231 B2
(45) Date of Patent: Apr. 1, 2014

(54) DRINK ADDITIVE DELIVERY LID SYSTEM

(75) Inventors: Marvin Lane, Round Lake Beach, IL (US); Richard J. Dias, Lake in the Hills, IL (US)

(73) Assignee: Thermos L.L.C., Schaumburg, IL (US)

( * ) Notice: Subject to any disclaimer, the term of this patent is extended or adjusted under 35 U.S.C. 154(b) by 476 days.

(21) Appl. No.: 12/579,585

(22) Filed: Oct. 15, 2009

(65) Prior Publication Data

US 2011/0089059 A1 Apr. 21, 2011

(51) Int. Cl.
*B67D 7/74* (2010.01)
*B67D 1/00* (2006.01)

(52) U.S. Cl.
USPC ..... 222/129; 222/80; 222/144.5; 206/219; 206/222; 220/521; 215/DIG. 8

(58) Field of Classification Search
USPC ..... 222/80, 129, 144.5; 206/219, 221, 222; 220/521; 426/112, 115; 604/410, 416; 215/DIG. 8
See application file for complete search history.

(56) References Cited

U.S. PATENT DOCUMENTS 5,035,320 A 7/1991 Plone
6,609,612 B2 * 8/2003 Vlodek ..... 206/222
6,959,841 B2 * 11/2005 Vlodek ..... 222/129
6,976,578 B1 12/2005 Kenihan
8,286,812 B2 * 10/2012 Buczkowski ..... 215/230
2002/0050461 A1 5/2002 Vlodek
2005/0087257 A1 4/2005 Snell et al.
2006/0226035 A1 * 10/2006 Smith et al. ..... 206/219
2008/0041738 A1 2/2008 O'Donnell et al.
2008/0202951 A1 * 8/2008 Landolt et al. ..... 206/222

FOREIGN PATENT DOCUMENTS

WO WO 2008011916 A1 * 1/2008

* cited by examiner

*Primary Examiner* — Kevin P Shaver
*Assistant Examiner* — Nicholas J Weiss
(74) *Attorney, Agent, or Firm* — Wood, Phillips, Katz, Clark & Mortimer

(57) ABSTRACT

A drink additive lid system (10) is provided for selectively introducing a drink additive (12) to a beverage container (14) closed by the lid system (10). The system (10) includes a plurality of additive compartments (20), each compartment (20) containing a drink additive (12), and a lid (22) attachable to a beverage container (14) to close a fill opening (16) of the beverage container (14). The lid (22) carries the compartments (20) and includes a drinking port (67) to allow beverage to pass from inside of the container (14) to the mouth of a user, and an actuator (24) mounted to be sequentially positioned adjacent each additive compartment (20) to allow a user to sequentially dispense the additive (12) from each additive compartment (20) into the beverage container (14) by engaging the actuator (24) with the compartment (20).

15 Claims, 7 Drawing Sheets

102
104
108
50
62
60
66
58
82
74
64
64
56
45
44
46
42
42
26
40
40
38
43
38
38
40

DRINK ADDITIVE DELIVERY LID SYSTEM

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to refillable beverage containers and additives/drink mixes for use with the beverage in such container, and in more particular applications, to refillable water bottles and additive/drink mixes for use in such bottles.

BACKGROUND OF THE INVENTION

The use of beverage containers in the form of refillable water bottles is becoming increasingly popular, particularly in view of an increasing understanding of the desirability of remaining hydrated and also in view of environmental concerns with respect to disposable, single use beverage containers. Associated with such hydration is the use of additives, such as drink mixes, that can be added to the water to add flavor and/or nutritional/health supplements to increase the enjoyment and/or health benefit of remaining hydrated. Typically, such mixes are poured into the open beverage container either before or after the water is added and then the beverage container is closed by a lid that allows a user to selectively open and close a drinking port that allows the beverage to be delivered from the interior of the container to the user.

SUMMARY OF THE INVENTION

In accordance with one feature of the invention, a drink additive lid system is provided for selectively introducing a drink additive to a beverage container closed by the lid system. The system includes a plurality of additive compartments, each compartment containing a drink additive, and a lid attachable to a beverage container to close a fill opening of the beverage container. The lid carries the compartments and includes a drinking port to allow beverage to pass from inside of the container to the mouth of a user, and an actuator mounted to be sequentially positioned adjacent each additive compartment to allow a user to sequentially dispense the additive from each additive compartment into the beverage container by engaging the actuator with the compartment.

As one feature, the system further includes an additive cartridge defining the plurality of additive compartments, the cartridge releasably attached to the lid to allow the cartridge to be selectively attached and removed from the lid. In a further feature, the cartridge has a cylindrical beverage passage extending along a central axis, a cylindrical outer wall spaced radially outwardly from passage, and three walls extending radially between the passage and the outer wall to define the compartments therebetween.

According to one feature, the additive compartments are circumferentially spaced around a central axis.

In one feature, the actuator is mounted for circumferential movement around the central axis to be sequentially positioned above each of the additive compartments.

As one feature, the lid includes a base mounting the additive compartments, and an actuator carrier mounted to the base for rotation about the central axis to sequentially position the actuator above the additive compartments, with the actuator being a plunger mounted in the actuator carrier to translate between a ready position where the actuator does not engage an additive compartment and a dispensing position wherein the actuator engages an additive compartment to dispense the additive therefrom into the beverage container.

In one feature, the lid further includes a flip top mounted to the actuator carrier for movement between a closed position wherein the flip top covers the drinking port and the actuator and an open position wherein the drinking port and actuator are accessible to a user.

According to one feature, the lid further includes a seal member mounted on one of the actuator carrier and the base, the sealing member having a resilient, annular lip extending radially inwardly for sealing rotational engagement with the other of the actuator carrier and the base.

As one feature, the seal member includes a resilient hood that extends over the actuator.

In a further feature, the seal member and the resilient hood are part of a unitary resilient component that includes the resilient lip.

According to one feature, each compartment is closed by a frangible element that is openable by engagement of the actuator with the compartment to dispense the additive.

In one feature, the system further includes a rigid element in each compartment extending from the location engageable by the actuator to a location engageable with the frangible element to transmit an opening force from the actuator to the frangible element.

In one feature, the system further includes a hollow insert in each compartment extending from the location engageable by the actuator to a location engageable with the frangible element to transmit an opening force from the actuator to the frangible element. The insert defines a chamber containing the additive and has an open end facing the frangible element.

In accordance with one feature of the invention, a drink additive lid system is provided for selectively introducing a drink additive to a beverage container closed by the lid system. The system includes a plurality of circumferentially spaced additive compartments, each compartment containing a drink additive, and a lid attachable to a beverage container to close a fill opening of the beverage container. The lid carries the compartments and includes a drinking port to allow beverage to pass from inside of the container to the mouth of a user, and an actuator mounted for circumferential movement to be sequentially positioned adjacent each additive compartment to allow a user to sequentially dispense the additive from each additive compartment into the beverage container by engaging the actuator with the compartment.

In one feature, the lid includes a base mounting the additive compartments, and an actuator carrier mounted to the base for rotation about the central axis to sequentially position the actuator adjacent the additive compartments. The actuator is a plunger mounted in the actuator carrier to translate between a ready position where the actuator does not engage an additive compartment and a dispensing position wherein the actuator engages an additive compartment to dispense the additive therefrom into the beverage container.

As one feature, the lid further includes a flip top hinged to the actuator carrier for movement between a closed position wherein the flip top covers the drinking port and the actuator and an open position wherein the drinking port and actuator are accessible to a user.

According to one feature, the lid further includes a seal member mounted on one of the actuator carrier and the base, the sealing member having a resilient, annular lip extending radially inwardly for sealing rotational engagement with the other of the actuator carrier and the base.

As one feature, the seal member includes a resilient hood that extends over the actuator.

In a further feature, the seal member and the resilient hood are part of a unitary resilient component that includes the resilient lip.

According to one feature, each compartment is closed by a frangible element that is openable by engagement of the actuator with the compartment to dispense the additive.

In one feature, the system further includes a rigid element in each compartment extending from the location engageable by the actuator to a location engageable with the frangible element to transmit an opening force from the actuator to the frangible element.

In one feature, the system further includes a hollow insert in each compartment extending from the location engageable by the actuator to a location engageable with the frangible element to transmit an opening force from the actuator to the frangible element. The insert defines a chamber containing the additive and has an open end facing the frangible element.

In accordance with one feature of the invention, a drink additive lid system is provided for selectively introducing a drink additive from each of a plurality of additive compartments to a beverage container closed by the lid system. The system includes a lid attachable to a beverage container to close a fill opening of the beverage container, with the lid including a drinking port to allow beverage to pass from inside of the container to the mouth of a user, and an actuator mounted for movement to be sequentially positioned adjacent each additive compartment to allow a user to sequentially dispense the additive from each additive compartment into the beverage container by engaging the actuator with the compartment.

As one feature, the lid includes a base mountable to the beverage container, and an actuator carrier mounted to the base for rotation about the central axis to sequentially position the actuator adjacent the additive compartments, with the actuator being a plunger mounted in the actuator carrier to translate between a ready position where the actuator does not engage an additive compartment and a dispensing position wherein the actuator engages an additive compartment to dispense the additive therefrom into the beverage container.

According to one feature, the lid further includes a flip top mounted to the actuator carrier for movement between a closed position wherein the flip top covers the drinking port and the actuator and an open position wherein the drinking port and actuator are accessible to a user.

In one feature, the drinking port is defined in the actuator carrier.

Other objects, features, and advantages of the invention will become apparent from a review of the entire specification, including the appended claims and drawings.

DETAILED DESCRIPTION OF THE PREFERRED EMBODIMENT

With references to FIGS. 1-4, a drink additive lid system 10 is shown for selectively introducing a drink additive 12 to a beverage container 14 (shown in phantom) closed by the lid system 10. The drink additive 12 can be any type of flavored drink mix and/or nutritional supplement, and will typically be provided in powdered form, but could also be provided in liquid, solid, or even gaseous form. The beverage container 14 can be of any type or construction, many of which are known, particularly for water bottles, all of which include a fill opening 16 that allows a beverage, such as water, to be introduced into the interior of the container 14 when the fill opening is not closed by a lid.

Figure 1:
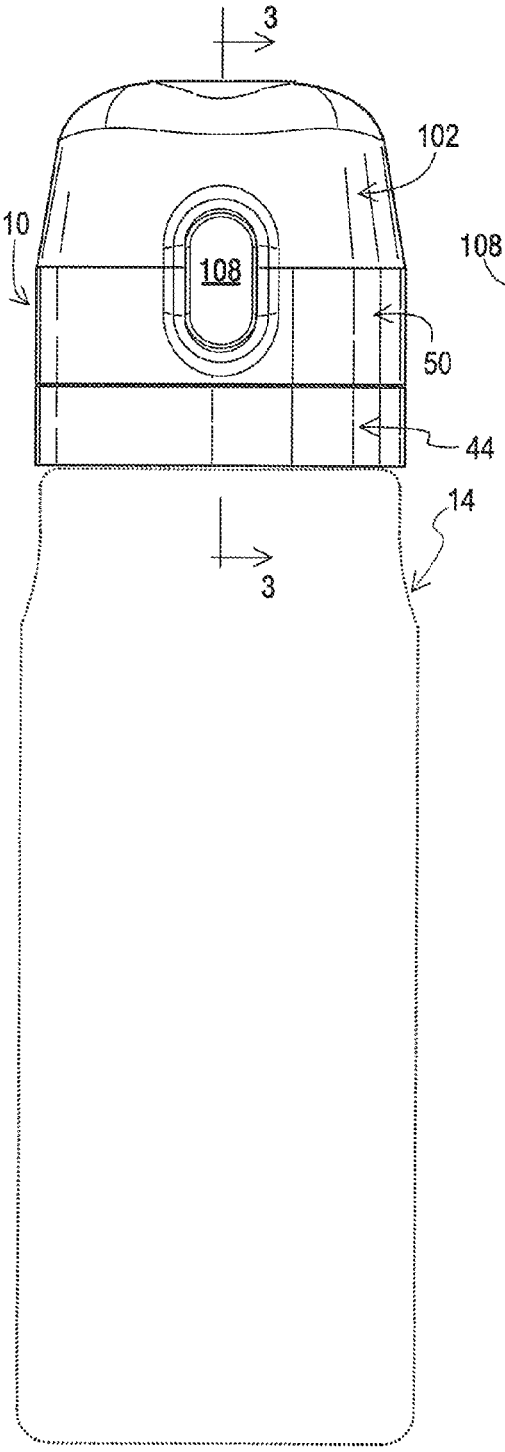
FIG. 1 is a front elevation of a drink additive lid system embodying the present invention together with a beverage container shown in phantom.
Figure 2:
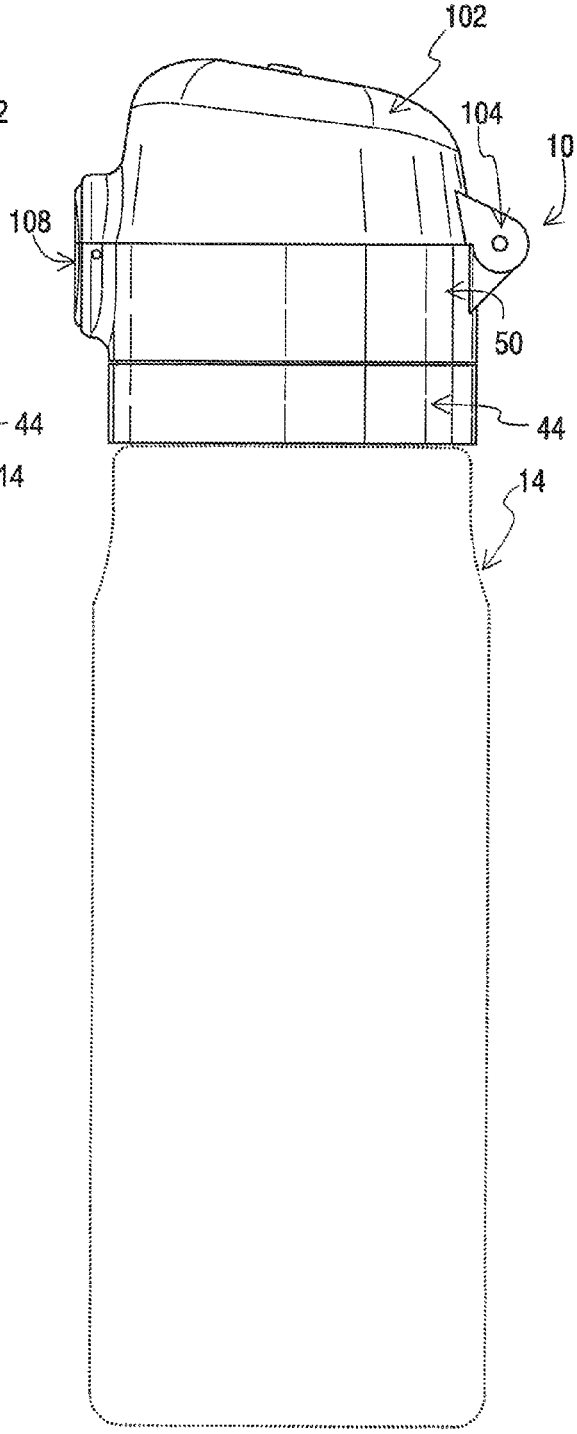
FIG. 2 is a side elevation of the drink additive system and beverage container of FIG. 1.
Figure 4:
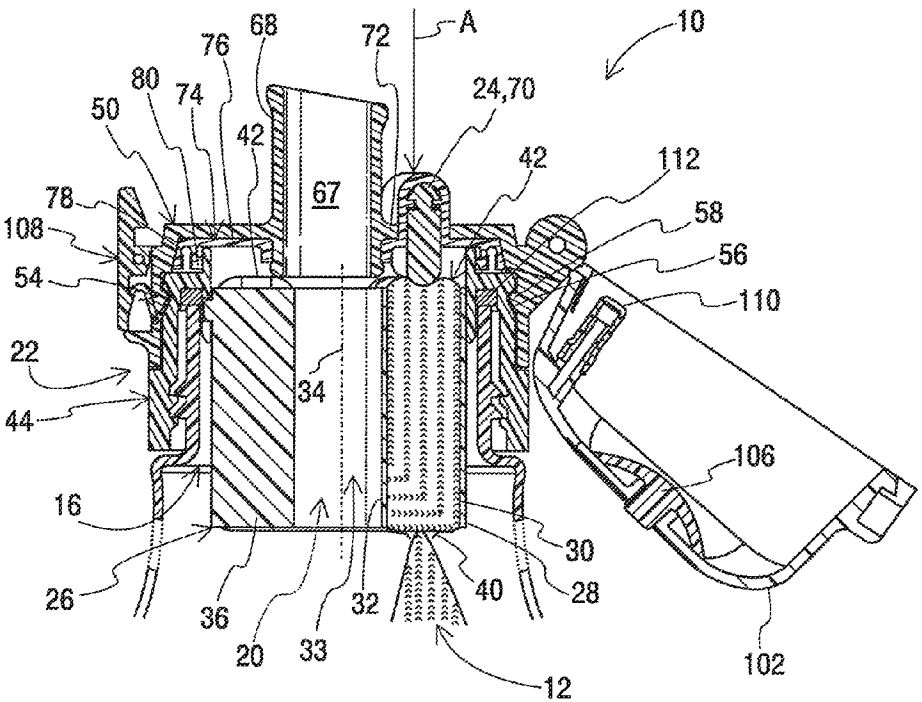
FIG. 4 is a view similar to FIG. 3, but showing the lid in an open position.
Figure 3:
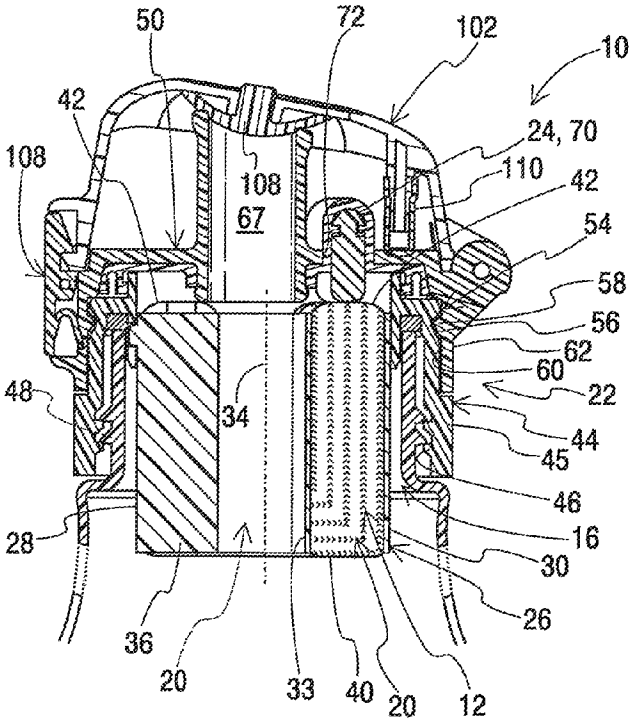
FIG. 3 is an enlarged section view taken from line 3-3 in FIG. 1, with the lid shown in a closed position.

As best seen in FIGS. 3 and 4, the drink additive lid system 10 includes a plurality of additive compartments/chambers 20 containing the additive 12, and a lid 22 that is attachable to the beverage container 14 to close the fill opening 16. The lid 22 includes an actuator 24 mounted to be sequentially positioned adjacent each additive compartment 20 to allow a user to sequentially dispense the additive 12 from each additive compartment 20 by engaging the actuator 24 with the compartment 20, as shown by Arrow A in FIG. 4.

Figure 5:
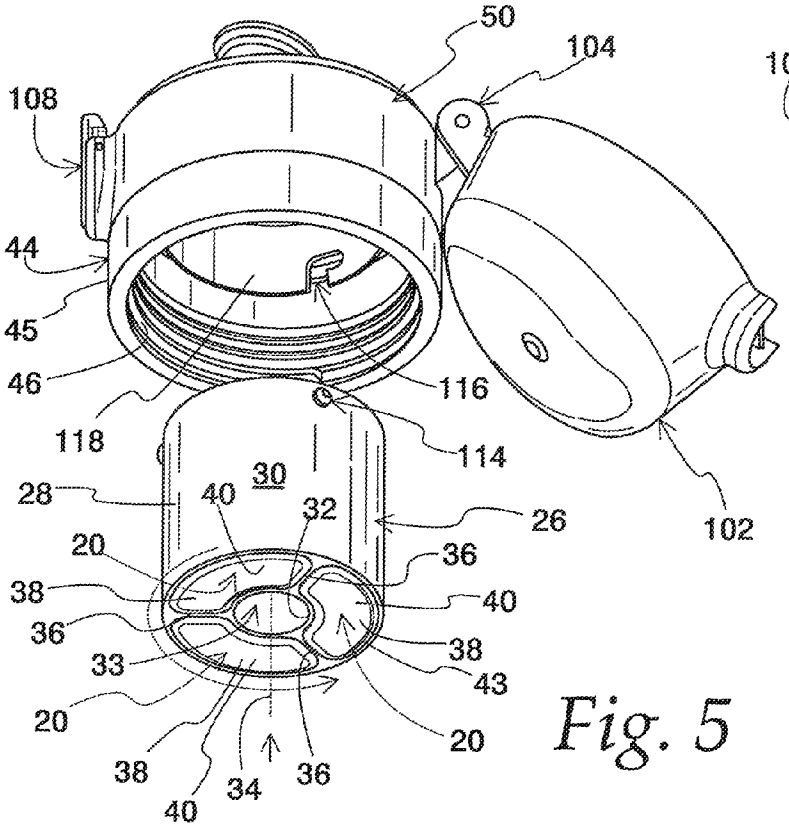
FIG. 5 is a perspective view from below of the drink additive lid system of FIGS. 1-4.
Figure 7:
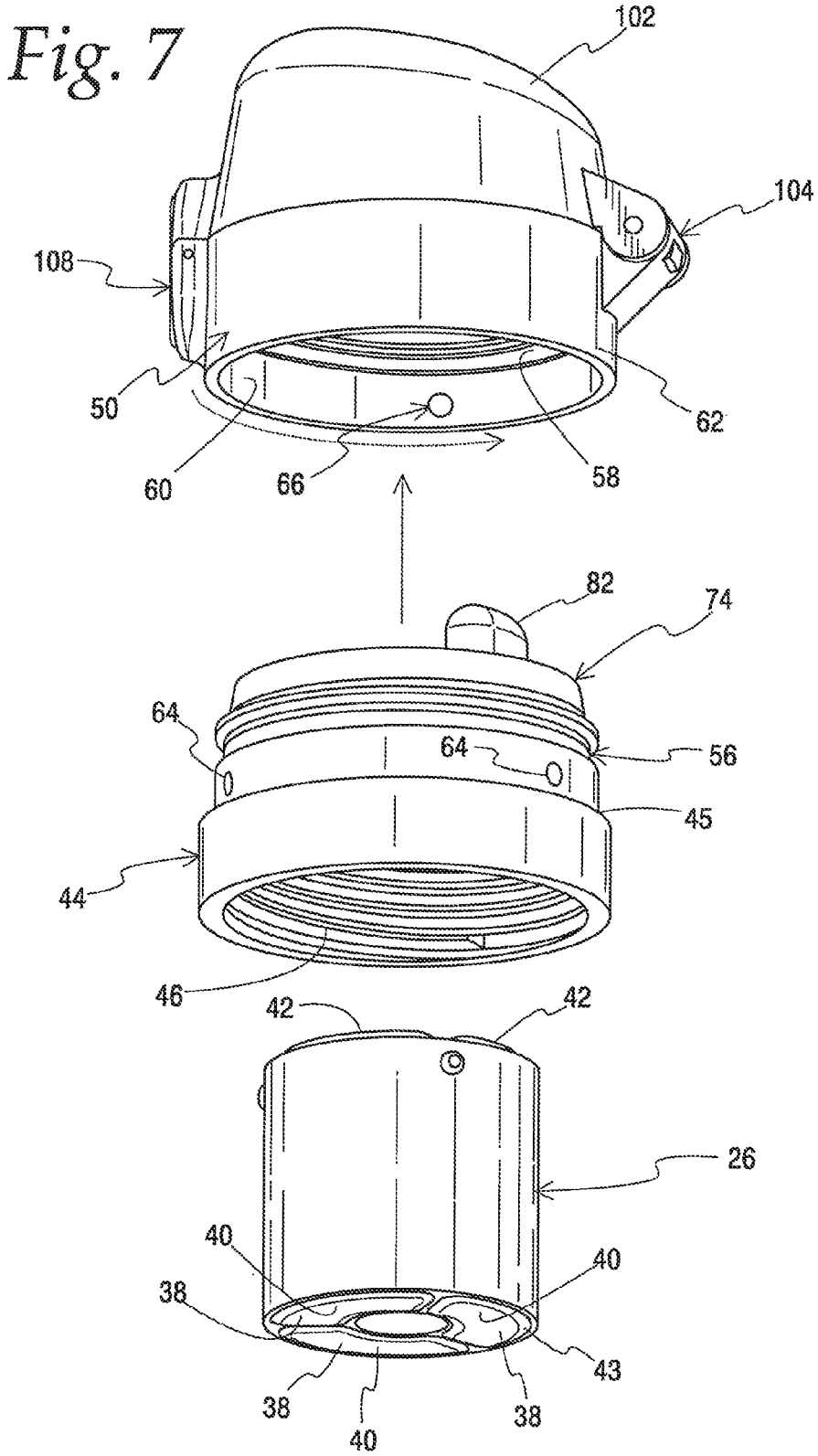
FIG. 7 is another exploded perspective view from below of the drink additive lid system of FIGS. 1-6.
Figure 10:
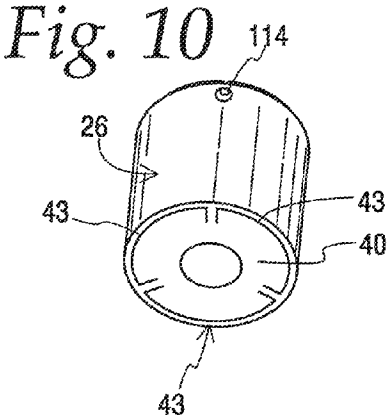
FIG. 10 is a perspective view from below of the cartridge of FIG. 9.
Figure 15:
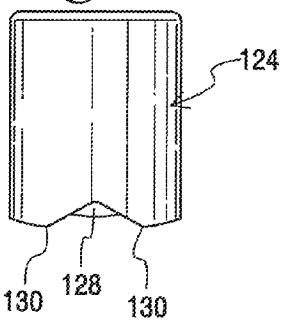
FIG. 15 is an elevation view of the insert taken from line 15-15 in FIG. 14.
Figure 9:
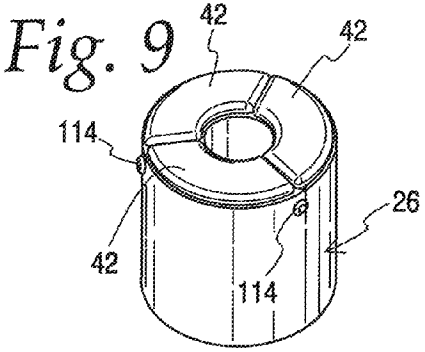
FIG. 9 is a perspective view from above of an additive cartridge for use in the system according to the invention.
Figure 14:
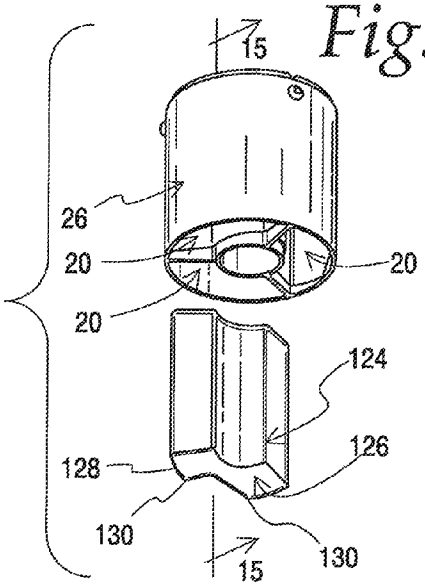
FIG. 14 is an exploded perspective view from below showing an additive cartridge and insert for use in the system.

Preferably, the compartments 20 are defined by a cartridge 26 mounted to the lid 22, preferably so that the cartridge 26 can be selectively mounted and removed from the lid 22, as best seen in FIGS. 3-5. In the illustrated embodiment, the cartridge 26 has a generally cylindrical body or housing 28 that defines three of the compartments 20 between an outer cylindrical wall 30, an inner cylindrical wall 32 defining a beverage passage 33 centered on a longitudinal axis 34, and three walls 36 that extend radially between the cylindrical walls 30 and 32. As best seen in FIGS. 5 and 7, each of the three compartments 20 has an arcuate port 38 also defined by the walls 30, 32 and 36, with each of the ports 38 being closed by a frangible element 40, such as thin foil or other film 40 that is pre-perforated for a controlled tear to release the additive 12 when the actuator 24 is engaged with the compartment 20. In this regard, as best seen in FIG. 9, a resilient plastic cover 42 is provided at the top of each of the compartments 20 for engagement by the actuator 24 so that the cover is deformed by the actuator 24 to force the additive 12 against the frangible element 40 to open the frangible element 40 and dispense the additive 12. The resilient cover 42 can be a separate component that is bonded or joined to the cartridge 26 or can be a one-piece construction with the cartridge 26. The frangible element 40 can be provided in any suitable form, including one wherein perforations are provided around an entire periphery 43, as seen in FIGS. 5 and 7, or one where the perforations only extend only partially around the perimeter 43 as best seen in FIG. 10. It should be understood that while the cartridge 26 is shown as defining three compartments 20, it may be desirable for the cartridge to define more or fewer of the compartments 20 depending upon the requirements of a particular application.

The lid 22 includes a base 44 that mounts the cartridge 26 and associated additive compartments 20. The base 44 is adapted for releasable attachment to the beverage container 14. In this regard, in the illustrated embodiment, the base 44 includes a downwardly extending, generally cylindrical skirt 45 having internal threads 46 for engagement with external threads 48 on the beverage container 14 to allow threaded engagement of the lid 22 with the beverage container 14. However, it should be understood, that any suitable attachment method, including push/snap-type connections may be utilized depending upon the requirements of each particular application.

The lid 22 further includes an actuator carrier 50 that is mounted to the base 44 for rotation about the axis 34 so that the actuator 24 can be sequentially positioned above each of the compartments 20 in the cartridge 26. Preferably, there is a snap fit, rotatable connection 54 between the base 44 and the carrier 50 defined by an outwardly facing, annular groove 56 that extends around a circumference of the skirt 45 to receive a conforming annular rib 58 that extends circumferentially around an interior surface 60 of a generally cylindrical skirt 62 of the actuator carrier 50, as best seen in FIG. 7. Preferably, mating index features, such as recesses 64 and conforming bumps 66, are circumferentially spaced around the base 44 and the carrier 50 for mating engagement when the actuator 24 is positioned above each of the compartments 20 to provide accurate indexing of the carrier 50 by a user when rotating the carrier 50 to position the actuator 24 over one of the compartments 20. The recesses 64 and conforming bumps 66 can take any suitable form, such as, for example, semispherical in shape as shown in FIG. 7 or semicylindrical as shown in FIG. 10.

As best seen in FIG. 4, a drinking port 67 is provided in the lid 22 to allow a user to drink a beverage from the container 14 by allowing beverage to pass from the interior of the container 14 through port 67 of the lid 22 to the user. In the illustrated embodiment, the drinking port 67 is defined in the actuator carrier 50 by a spout 68.

Figure 6:
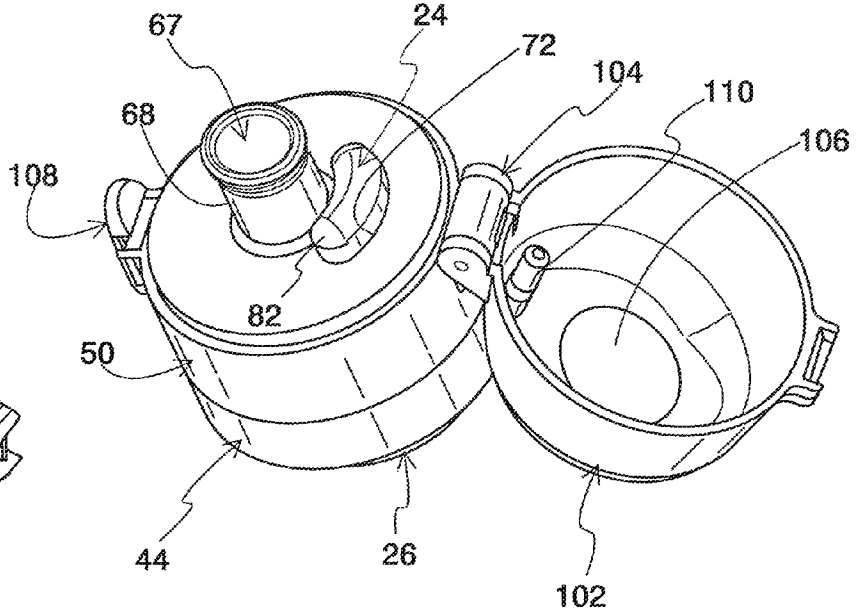
FIG. 6 is an exploded perspective view from above of the drink additive lid system of FIGS. 1-5.

In the illustrated embodiment, the actuator 24 is provided in the form of a plunger 70 that is mounted in the carrier 50 for translation parallel to the axis 34 between a ready position shown in FIG. 3 and a dispensing position shown in FIG. 4 where the plunger 70 has been pressed downwardly by a user into engagement with the cover 42 of one of the compartments 20 to force the additive 12 against the corresponding perforated foil 40 to break the foil 40 and dispense the additive 12 from the compartment 20 and into the container 14. In this regard, as best seen in FIG. 6, the plunger 70 preferably has an arcuate cross-sectional shape that mimics the shape of each of the chambers 20, and the carrier 50 preferably has an actuator opening 72 that conforms to the arcuate cross-sectional shape and slidably receives the plunger 70.

Figure 8:
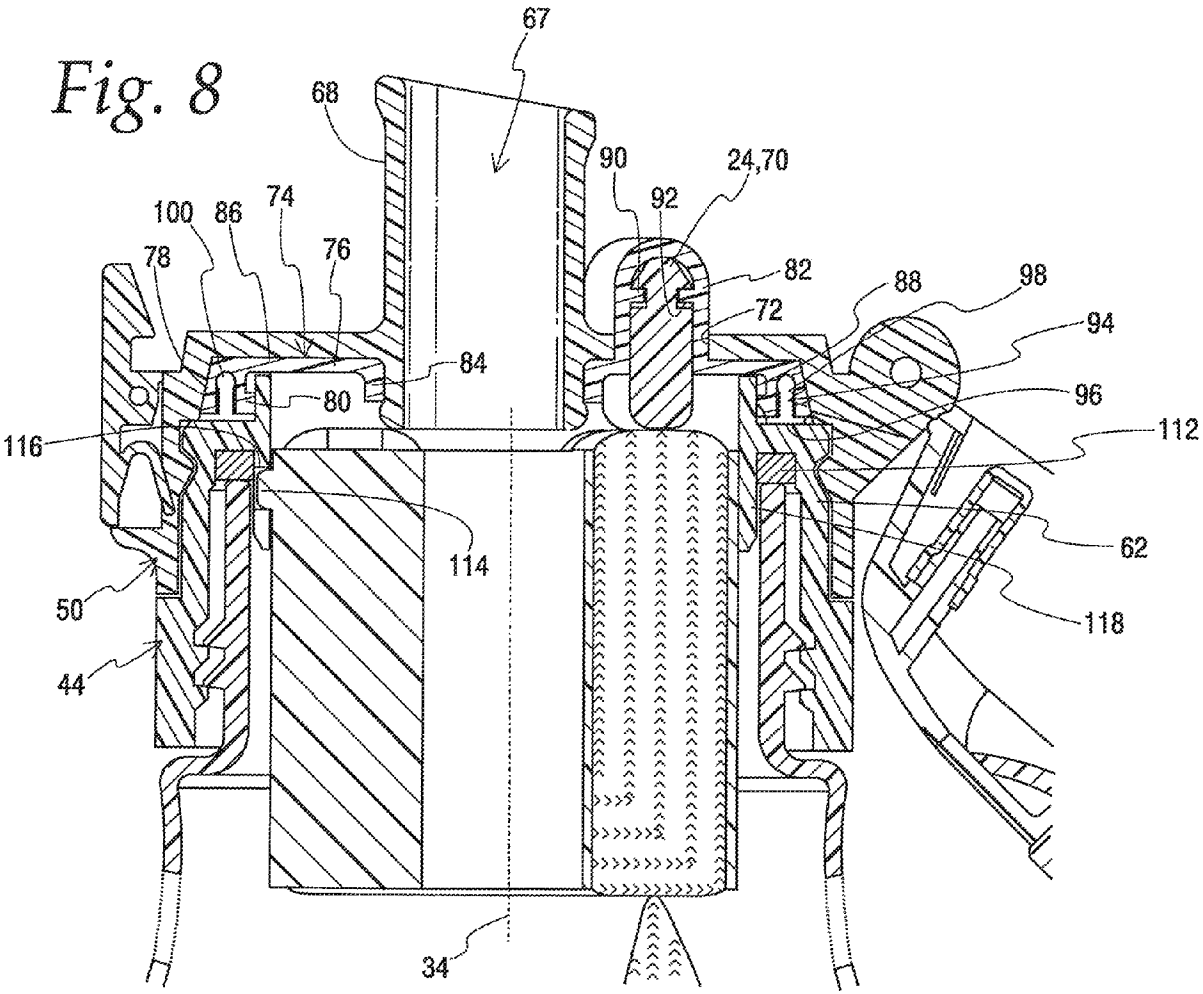
FIG. 8 is a further enlarged view similar to FIG. 2.
Figure 11:
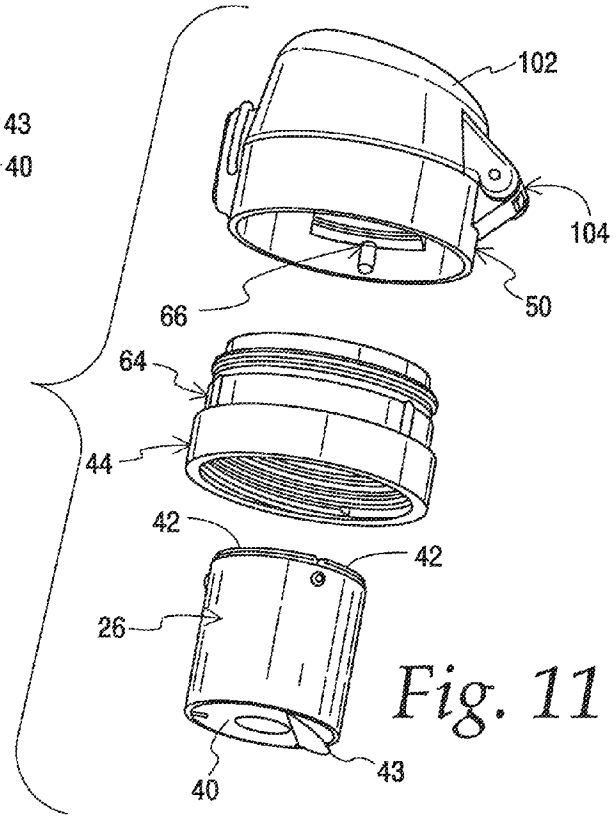
FIG. 11 is an exploded perspective view from below showing an alternate embodiment of the drink additive lid system, including the cartridge of FIGS. 9 and 10.

Preferably, as best seen in FIG. 8, the lid 22 also includes a seal member 74 mounted in the carrier 50 to inhibit or prevent leakage around the interfaces between the carrier 50 and the base 44 and between the carrier 50 and the actuator 25. The seal member preferably includes a unitary resilient component 76 that defines an annular ring 78, a radially inwardly directed lip seal 80, a hood 82, a cylindrical stub 84, and a planer base 86 extending between the stub 84, hood 82, and ring 78. The lip seal 80 engages a cylindrical sealing surface 88 on the base 44 to provide a rotational seal that inhibits or prevents leakage of the beverage from the corresponding interface while allowing the carrier 50 to be rotated about the axis 34 relative to the base 44. The hood 82 extends over the plunger 70 and between the plunger 70 and the opening 72 to inhibit or prevent leakage of the beverage from the associated interface while allowing the plunger 70 to translate between the ready and dispensing positions. Preferably, the resiliency of the hood 82 is utilized to urge the plunger 70 toward the ready position via an inwardly directed rib 90 of the hood 80 that extends around the plunger 70 to engage with a conforming slot 92 on in the plunger 70. The ring 78, cylindrical stub 84 and planer base 86 all engage corresponding seal surfaces on the carrier 50 to inhibit or prevent leakage of the beverage from the associate interface of the unitary component 76 and the carrier 50. Preferably, the seal member 74 also includes an annular shaped stiffener/glide ring 94 having glide ring 96 and a cylindrical stiffener 98 extending upward from the ring 96 and embedded in the ring 78 to stiffen the ring 78 and to provide a lower friction sliding interface between the seal member 74 and the base 44. Preferably, the stiffener 98 had an enlarged end 100 to help retain the stiffener 98 in the ring 78. Preferably, the unitary component 76 is molded from a suitable resilient seal material, such as, for example, a silicon rubber, and the stiffener/glide ring 94 is molded from a suitable plastic that will provide adequate rigidity and a low coefficient of friction with the material of the base 44.

The lid 22 preferably also includes a flip top 102 that is mounted by a hinge 104 to the carrier 50 for movement between a closed position (shown in FIGS. 1-3 and 7) wherein the top 102 closes the drinking port 67 and covers the actuator 22, and an open position (shown in FIGS. 4-6) wherein the top 102 is pivoted away from the drinking port 67 and actuator 22 to allow access thereto by a user. Preferably, the lid 102 mounts a convex, disc shaped seal 106 that engages with the drinking port 67 to inhibit or prevent leakage of the beverage therefrom with the top 102 in the closed position. The illustrated embodiment of the lid 22 also includes a latch 108 that is pivoted on the base 44 into biased engagement with the top 102 in the closed position to retain the top 102 in the closed position until the latch 108 is pivoted away from the top 102 by a user. In this regard, the illustrated embodiment also includes a resilient member 110 mounted on the top 102 to be compressed in the closed position so as to urge the top 102 from the closed position to the open position when the latch 108 is disengaged by a user.

Preferably, the base 44 includes a suitable seal or gasket 112 that engages with a seal surface on the beverage container 14 to inhibit or prevent leakage of the beverage from the associate interface.

As shown in FIGS. 5 and 8, a bayonet type releasable connection is provided between the cartridge 26 and the carrier 50, with the cartridge 26 having studs 114 that are received in corresponding bayonet type slots 116 provided in a cylindrical wall 118 of the carrier 50 that is positioned radially inwardly of the skirt 62. While a bayonet type releasable connection is shown, it should be understood that other suitable types of releasable connections may be desirable depending upon the requirements of any particular application. The releasable connection allows for a used cartridge 26 to be replaced with a new cartridge 26.

Figure 13:
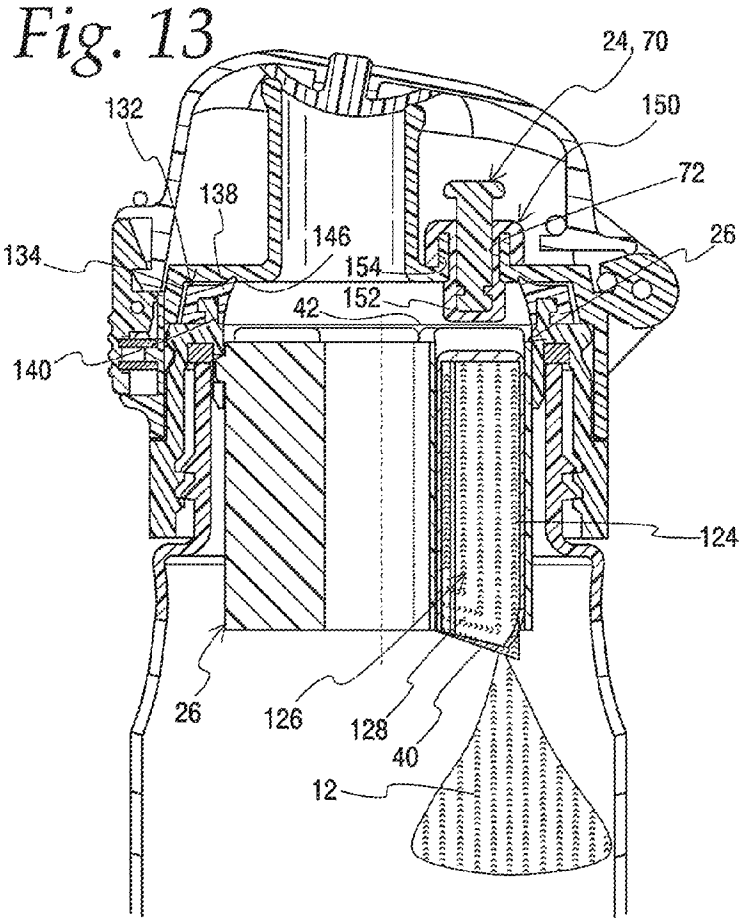
FIGS. 12 and 13 are views similar to FIGS. 3 and 4, but showing an alternate embodiment of the drink additive system.
Figure 12:
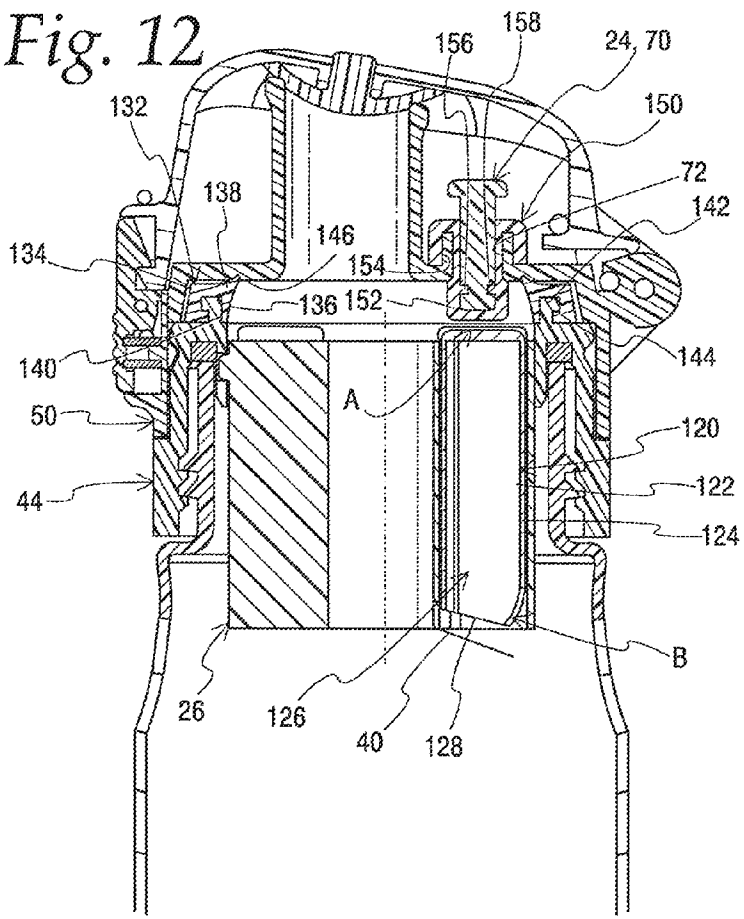

As best seen in FIGS. 12 and 13, in some applications where the physical properties of the additive 12 prevent the additive 12 from transmitting a sufficient force from the actuator 24 to open the frangible element 40, it may be desirable to include an element 120 in each of the compartments 20 that is engageable by the actuator 24 to transmit an opening force from the actuator 24 to the frangible element 40. In the illustrated embodiment, the element 120 is provided in the form of a rigid structure 122 that extends from a location A engageable by the actuator 24 to a location B engageable with the frangible element 40 to transmit the opening force from the actuator 24 to the frangible element 40. As best seen in FIGS. 12-15, in a highly preferred form, the element 120 is provided in the form of a hollow insert 124, which is preferably a rigid structure. The insert 124 defines a chamber 126 containing the additive 12 and has an open end 128 facing the frangible element 40. The open end 128 preferably includes protrusions 130 that engage selected portions of the frangible element 40, which is believed to enhance the opening of the frangible element 40.

FIGS. 12 and 13 illustrate an optional embodiment wherein the seal member 74 of FIGS. 1-8 is replaced with a seal member 132 mounted to the base 44 to inhibit or prevent leakage around the interfaces between the carrier 50 and the base 44. The seal member 132 preferably includes a unitary resilient component 134 that defines an annular ring 136 having an axially upwardly extending lip seal 138 and a downwardly opening annular channel 140. The downwardly opening annular channel 140 engages an upwardly extending annular rib 142 on the base 44, with interlocking shoulders 144 on the channel 140 and rib 142 engaging each other to retain the seal member 132 to the base 44. The lip seal 138 engages a downwardly facing planar surface 146 on the carrier 50 to provide a rotational seal that inhibits or prevents leakage of the beverage from the corresponding interface while allowing the carrier 50 to be rotated about the axis 34 relative to the base 44. Furthermore, the hood 82 of the seal member 74 has been replaced with a separate seal member 150 that is made as a unitary resilient component and has a downwardly extending hood 152 surrounded by a downwardly opening groove 154. The hood 152 extends downwardly over the plunger 70 and between the plunger 70 and the opening 72 to inhibit or prevent leakage of the beverage from the associated interface while allowing the plunger 70 to translate between the ready and dispensing positions. Preferably, the resiliency of the hood 152 is utilized to urge the plunger 70 toward the ready position, with the hood 152 including an inwardly directed rib 156 that engages a groove 158 extending around the plunger 70 to retain the plunger 70 within the seal member 150. The downwardly opening groove 154 engages an upwardly extending wall of the carrier 50 that surrounds the opening 72.

It should be appreciated that the system 10 allows for drink additives 12 to be conveniently dispensed to a beverage container during multiple refills of the drink container. The system 10 conveniently stores the additives 12 so they do not have to be carried separately from the beverage container, and dispenses multiple doses of drink additives 12 without requiring the handling and/or disposal of separate containers for the drink additives 12.

The invention claimed is:

1. A drink additive lid system for selectively introducing a drink additive to a beverage container closed by the lid system, the system comprising:

a plurality of additive compartments, each compartment containing a drink additive;

a lid attachable to a beverage container to close a fill opening of the beverage container, the lid carrying the compartments and comprising:

a drinking port to allow beverage to pass from inside of the container to the mouth of a user, and an actuator mounted to be sequentially positioned adjacent each additive compartment to allow a user to sequentially dispense the additive from each additive compartment into the beverage container by engaging the actuator with the compartment;

an additive cartridge defining the plurality of additive compartments, the cartridge releasably attached to the lid to allow the cartridge to be carried in the lid and selectively attached and removed from the lid, the additive compartments circumferentially spaced around a central axis;

wherein the actuator is mounted for circumferential movement around the central axis to be sequentially positioned above each of the additive compartments;

the lid further comprises a base mounting the additive compartments;

an actuator carrier mounted to the base for rotation about the central axis to sequentially position the actuator above the additive compartments, the actuator being a plunger mounted in the actuator carrier to translate between a ready position where the actuator does not engage an additive compartment and a dispensing position wherein the actuator engages an additive compartment to dispense the additive therefrom into the beverage container; and a seal member mounted on one of the actuator carrier and the base, the seal member having a resilient, annular lip for sealing rotational engagement with the other of the actuator carrier and the base.

2. The system of claim 1 wherein the cartridge has a cylindrical beverage passage extending along a central axis, a cylindrical outer wall spaced radially outwardly from the passage, and three walls extending radially between the passage and the outer wall to define the compartments therebetween.

3. The system of claim 1 wherein the lid further comprises a flip top mounted to the actuator carrier for movement between a closed position wherein the flip top covers the drinking port and the actuator and an open position wherein the drinking port and actuator are accessible to a user.

4. The system of claim 1 further including a resilient hood that extends over the actuator.

5. The system of claim 4 wherein the seal member and the resilient hood are part of a unitary resilient component that includes the resilient lip.

6. The system of claim 1 wherein each compartment is closed by a frangible element that is openable by engagement of the actuator with the compartment to dispense the additive.

7. The system of claim 6, further comprising a rigid element in each compartment extending from a location engageable by the actuator to a location engageable with the frangible element to transmit an opening force from the actuator to the frangible element.

8. The system of claim 6 further comprising a hollow insert in each compartment extending from a location engageable by the actuator to a location engageable with the frangible element to transmit an opening force from the actuator to the frangible element, the insert defining a chamber containing the additive and having an open end facing the frangible element.

9. A drink additive lid system for selectively introducing a drink additive to a beverage container closed by the lid system, the system comprising:

a plurality of circumferentially spaced additive compartments, each compartment containing a drink additive;

a lid attachable to a beverage container to close a fill opening of the beverage container, the lid carrying the compartments and comprising:

a drinking port to allow beverage to pass from inside of the container to the mouth of a user, and an actuator mounted for circumferential movement to be sequentially positioned adjacent each additive compartment to allow a user to sequentially dispense the additive from each additive compartment into the beverage container by engaging the actuator with the compartment;

a base mounting the additive compartments; and an actuator carrier mounted to the base for rotation about the central axis to sequentially position the actuator adjacent the additive compartments, the actuator being a plunger mounted in the actuator carrier to translate between a ready position where the actuator does not engage an additive compartment and a dispensing position wherein the actuator engages an additive compartment to dispense the additive therefrom into the beverage container;

wherein the lid further comprises a seal member mounted on one of the actuator carrier and the base, the seal member having a resilient, annular lip for sealing rotational engagement with the other of the actuator carrier and the base.

10. The system of claim 9 wherein the lid further comprises a flip top hinged to the actuator carrier for movement between a closed position wherein the flip top covers the drinking port and the actuator and an open position wherein the drinking port and actuator are accessible to a user.

11. The system of claim 9 wherein the seal member includes a resilient hood that extends over the actuator.

12. The system of claim 11 wherein the seal member and the resilient hood are part of a unitary resilient component that includes the resilient lip.

13. The system of claim 9 wherein each compartment is closed by a frangible element that is openable by engagement of the actuator with the compartment to dispense the additive.

14. The system of claim 13 further comprising a rigid element in each compartment extending from a location engageable by the actuator to a location engageable with the frangible element to transmit an opening force from the actuator to the frangible element.

15. The system of claim 13 further comprising a hollow insert in each compartment extending from a location engageable by the actuator to a location engageable with the frangible element to transmit an opening force from the actuator to the frangible element, the insert defining a chamber containing the additive and having an open end facing the frangible element.

* * * * *